US012471658B2

(12) United States Patent
Goldoni et al.

(10) Patent No.: US 12,471,658 B2
(45) Date of Patent: Nov. 18, 2025

(54) COMPONENT FOR A SHOE

(71) Applicant: GAITTECH S.R.L., Carpi (IT)

(72) Inventors: Andrea Goldoni, Rovigo (IT); Stefano Caiumi, Carpi (IT); Simone Marchesini, Budrio (IT); Marcello Benetti, Carpi (IT)

(73) Assignee: GAITTECH S.R.L., Carpi (IT)

( * ) Notice: Subject to any disclaimer, the term of this patent is extended or adjusted under 35 U.S.C. 154(b) by 0 days.

(21) Appl. No.: 17/997,611

(22) PCT Filed: Dec. 3, 2020

(86) PCT No.: PCT/IB2020/061428

§ 371 (c)(1),
(2) Date: Oct. 31, 2022

(87) PCT Pub. No.: WO2021/224674

PCT Pub. Date: Nov. 11, 2021

(65) Prior Publication Data

US 2023/0218036 A1 Jul. 13, 2023

(30) Foreign Application Priority Data

May 5, 2020 (IT) ..... 102020000009838

(51) Int. Cl.
*A43B 7/1485* (2022.01)
*A43B 7/1405* (2022.01)
(Continued)

(52) U.S. Cl.
CPC ..... *A43B 7/1485* (2013.01); *A43B 7/141* (2013.01); *A43B 7/1425* (2013.01);
(Continued)

(58) Field of Classification Search
CPC ..... A43B 7/141; A43B 7/1425; A43B 7/1445; A43B 7/148; A43B 7/1485; A43B 7/1405; A43B 7/145
See application file for complete search history.

(56) References Cited

U.S. PATENT DOCUMENTS 1,444,747 A * 2/1923 McNulty ..... A43B 13/18 36/94
2,106,508 A * 1/1938 Shaw ..... A43B 7/14 36/43

(Continued)

FOREIGN PATENT DOCUMENTS

DE 514063 C 12/1930
WO 2008146376 A1 12/2008

*Primary Examiner* — Heather Mangine
(74) *Attorney, Agent, or Firm* — Chrisman Gallo Tochtrop LLC

(57) ABSTRACT

A component for a shoe, intended to be interposed between a foot and the ground, is delimited by an upper surface which, in use, is turned towards the foot. The upper surface comprises a load-bearing region in which at least one recess is made, the recess being configured to receive at least one metatarsal head of the foot, so that in the load-bearing region a plurality of metatarsal support levels is defined, the metatarsal support levels being placed at different heights from one another and being intended to support the metatarsal heads of the foot. The plurality of metatarsal support levels comprises, in the more simplified embodiment, two different metatarsal support levels. In a more complex embodiment, three different metatarsal support levels are provided. In a more complete embodiment, five different metatarsal support levels are provided.

11 Claims, 3 Drawing Sheets

(51) Int. Cl.
*A43B 7/1425* (2022.01)
*A43B 7/1435* (2022.01)
*A43B 7/1445* (2022.01)
*A43B 7/148* (2022.01)

(52) U.S. Cl.
CPC ..... *A43B 7/1435* (2013.01); *A43B 7/1445* (2013.01); *A43B 7/148* (2013.01)

(56) References Cited

U.S. PATENT DOCUMENTS 2,159,054 A * 5/1939 Silver ..... A43B 7/1435 36/145
2,224,642 A * 12/1940 Burns ..... A43B 7/1445 36/178
2,631,387 A * 3/1953 Shaw ..... A43B 7/14 36/43
2,680,919 A * 6/1954 Riggs ..... A43B 7/1425 36/155
2,791,845 A * 5/1957 Kilman ..... A43B 23/22 36/44
2,884,719 A * 5/1959 Compton ..... A43B 7/1425 36/145
3,968,577 A * 7/1976 Jackson ..... A43B 7/141 36/43
4,188,736 A * 2/1980 Keller ..... A43B 7/1445 36/43
4,615,126 A * 10/1986 Mathews ..... A43B 7/1415 36/31
4,633,877 A * 1/1987 Pendergast ..... A43D 999/00 36/44
4,689,898 A * 9/1987 Fahey ..... A43B 7/144 36/43
4,783,910 A * 11/1988 Boys ..... A43B 7/1415 36/108
5,632,104 A * 5/1997 Zohar ..... A43B 7/14 36/94
5,768,803 A * 6/1998 Levy ..... A43B 7/1435 36/43
5,784,811 A * 7/1998 Mauch ..... A43B 7/1425 36/43
6,182,380 B1 * 2/2001 Liley ..... A43B 17/023 36/43
6,277,088 B1 * 8/2001 Novella ..... A43B 7/1435 36/145
6,412,194 B1 * 7/2002 Carlson ..... A43B 17/026 36/43
6,425,194 B1 * 7/2002 Brie ..... A43B 7/1445 264/222
9,289,028 B1 * 3/2016 Anderson ..... A43B 7/148
2006/0021251 A1 * 2/2006 Swigart ..... A43B 13/189 36/28
2008/0040948 A1 * 2/2008 Park ..... A43B 7/142 36/43
2009/0094856 A1 * 4/2009 Guerra ..... A43B 7/148 36/35 B
2009/0193683 A1 * 8/2009 Igdari ..... A43B 7/142 36/43
2012/0055045 A1 * 3/2012 Wang ..... A43B 7/1445 36/88
2012/0174436 A1 * 7/2012 Hanak ..... A43B 7/144 36/43
2012/0255199 A1 * 10/2012 Tzeng ..... A43B 7/1405 36/43
2012/0272545 A1 * 11/2012 Chenut ..... A61F 5/14 36/43
2013/0227859 A1 * 9/2013 Takayama ..... A43B 7/1425 36/88
2014/0259800 A1 * 9/2014 O'Reilly ..... A43B 7/1485 36/25 R
2014/0298680 A1 * 10/2014 Oloff ..... A43B 7/1435 36/43
2015/0121722 A1 * 5/2015 Hirose ..... A43B 17/02 36/44
2015/0196087 A1 * 7/2015 Meschter ..... A43C 15/168 36/25 R
2016/0316853 A1 * 11/2016 Iuchi ..... A43B 13/04
2017/0055628 A1 3/2017 O'Reilly et al.
2017/0150775 A1 * 6/2017 Hakkala ..... A43B 7/141
2018/0295937 A1 * 10/2018 Hedström ..... A43B 7/145
2019/0208860 A1 * 7/2019 Oloff ..... A43B 7/1425
2020/0037699 A1 2/2020 O'Reilly et al.
2020/0305545 A1 * 10/2020 Yahata ..... A43B 7/1435
2021/0330021 A1 * 10/2021 Engelman ..... A61F 5/0111
2022/0053880 A1 * 2/2022 Taylor ..... A43B 13/20
2022/0408877 A1 * 12/2022 Healy ..... A43B 7/144
2023/0062543 A1 * 3/2023 Tateno ..... A43B 13/188
2023/0218036 A1 * 7/2023 Goldoni ..... A43B 7/1405 36/180

* cited by examiner

COMPONENT FOR A SHOE

The present invention refers to the technical field of shoes.

In particular, the present invention relates to a component for a shoe having a particular housing for the metatarsal heads of the user's foot.

The component according to the invention is suitable for being interposed, in use, between the ground and the user's foot, in particular beneath the metatarsal heads of the foot. The component of a shoe according to the invention can for example be shaped as a sole, suitable for contacting the ground during use of the shoe, or as an insole suitable for directly contacting the user's foot, or again as a midsole interposed between the sole and the insole. Furthermore, the component of a shoe according to the invention can be of the extractable type, i.e. it can be removed from the shoe and replaced with another component, or it can be fixed to adjacent elements of the shoe.

The invention also concerns a shoe comprising the aforementioned component.

The component of a shoe according to the invention is preferably, but not exclusively, suitable for being associated with shoes having a high heel, i.e. a high height differential existing, in a configuration of use, between the support region of the forefoot, and in particular of the portion of the metatarsal arch adjacent to the proximal phalanges, and the support region of the calcaneus.

In the orthopaedic sector, and more specifically in the branch connected to the study of walking, the prevention and the treatment of pathologies and motorial limitations that can occur due to the use of shoes are extremely important.

The constant research, aimed at streamlining the silhouette of the leg and of the shoe, produces shoes that lead to high metabolic and biological costs on the human musculoskeletal system, generating the onset of multiple pathologies.

Taking as an example the use of shoes that include a high height differential or high heel, it is demonstrated how they can cause static-dynamic alterations of the entire locomotor system.

Specifically, the foot forced into a high-heeled shoe assumes a plantarflexion configuration, i.e. the anterior ligaments of the ankle are extended and the metatarsal arch is approximately vertical and turned to the ground.

In plantarflexion, the subtalar joint, with a supination movement, causes the midfoot and the forefoot to move medially in intra-rotation, it accomplishes an adduction (i.e. it approaches the midline of the body), consequently it lateralizes the load due to the weight force and directs it to the central metatarsal heads. The result is a lack of support in the first metatarsal, which aggravates the load on the second and third metatarsals, with a lack of support also on the fourth and on the fifth metatarsals.

In other words, a user wearing a shoe with a high heel rests her foot on the ground, discharging the weight force of the body almost entirely through the heads of the second and of the third metatarsals, causing an uneven and burdensome load distribution for the central metatarsals.

Since the cooperation of the head of the first, fourth and fifth metatarsals is reduced, a condition is produced in which the lower portion of the ankle, and in particular the subtalar, moves into a prone position trying to compensate for the instability created by the strong differential between the support of the heel and the metatarsal joint, i.e. by a high heel. This prevents the correct and necessary muscle involvement for a solid walking and effective standing position.

Furthermore, the vascular dynamism is reduced and the inflammation of the arthro-muscular tissues is favoured, with the possibility of the onset of related pathologies.

The same problems can occur proportionally even if shoes with a less accentuated differential or heel, in any case higher than 0 mm, are used. Specifically, these problems can arise in correlation with the more traumatic phases of walking, that is the monopodalic and propulsive phases.

However, the footwear sector currently does not foresee effective solutions for solving the above mentioned problems.

The known technique provides for adding to the insole, in an integral or reversible manner, a layer of soft material, in particular in the load-bearing region on which almost all of the weight force is discharged.

Other solutions provide for the use of plantar footbeds applied directly to the user's foot, near the metatarsal fascia. Such footbeds comprise at least one layer of soft material.

For both solutions, the strategy identified to tackle the problems outlined above is therefore to pad and soften the part of the shoe in contact with the metatarsal heads in order to improve the comfort through a cushioning effect.

These solutions only mitigate the effects of the problems without however addressing the causes.

A strongly felt need by shoe users is therefore to be able to use shoes, especially with reference to high-heeled shoes, which allow reducing the risk of having to face the consequences linked to the onset of the previously discussed problems.

In this context, the technical task underlying the present invention is to propose a component for a shoe, intended to be positioned between the foot and the ground, as well as a shoe, which reduce the discomfort of the aforementioned drawbacks.

In particular, it is an object of the present invention to make available a component for a shoe and a shoe capable of allowing a better and more comfortable walking for a user.

A further object of the present invention is to make available a component for a shoe and a shoe capable of improving the comfort of the user.

A further object of the present invention is to make available a component for a shoe and a shoe capable of improving the balance and the stability during the walking phases, in particular in the monopodalic loading phase and in the propulsive phase.

The specified technical task and the specified purposes are substantially achieved by a component for a shoe, intended to be interposed, in use, between the ground and the user's foot, having an upper surface which, in use, is turned towards the plantar surface of the user's foot.

The upper surface comprises a load-bearing region in which at least one recess is made, the recess being configured to receive at least one metatarsal head of the foot, so that in the load-bearing region a plurality of metatarsal support levels is defined, the metatarsal support levels being placed at different heights from one another and being intended to support the metatarsal heads of the foot.

In an embodiment, the metatarsal support levels comprise two metatarsal support levels, namely:

- a lowest metatarsal support level, defined by a bottom surface of the at least one recess mentioned above, for supporting the second and the third metatarsal heads of the foot;
- a highest metatarsal support level for supporting the remaining metatarsal heads of the foot.

In an embodiment, the metatarsal support levels comprise three metatarsal support levels, namely:

- a lowest metatarsal support level, defined by a bottom surface of the at least one recess mentioned above, for supporting the second and the third metatarsal heads of the foot;
- an intermediate metatarsal support level, defined by a bottom surface of a further recess, for supporting the first metatarsal head of the foot;
- a highest metatarsal support level, for supporting the fourth and the fifth metatarsal heads of the foot.

In an embodiment, the metatarsal support levels comprise five metatarsal support levels, namely:

- a lowest metatarsal support level, defined by a bottom surface of the at least one recess mentioned above, for supporting the second metatarsal head of the foot;
- a further metatarsal support level, defined by a bottom surface of a further recess, for supporting the first metatarsal head of the foot;
- a third metatarsal support level, defined by a bottom surface of a third recess, for supporting the third metatarsal head of the foot;
- a fourth metatarsal support level, defined by a bottom surface of a fourth recess, for supporting the fourth metatarsal head of the foot;
- a highest metatarsal support level, for supporting the fifth metatarsal head of the foot.

The present invention also relates to a shoe, preferably high-heeled, comprising the aforementioned component.

Advantageously, the component and the shoe of the present invention allow a more functional and comfortable walking for the user by favouring the arrangement of the metatarsal heads at different depths, which allows a better weight distribution.

Additional features and advantages of the present invention will become more apparent from the exemplifying, and hence non-limiting, description of a component for a shoe and of a shoe, particularly high-heeled, comprising this component.

This description will be set out below with reference to the appended drawings, which are provided solely for illustrative and therefore non-limiting purposes, in which.

Figure 1:
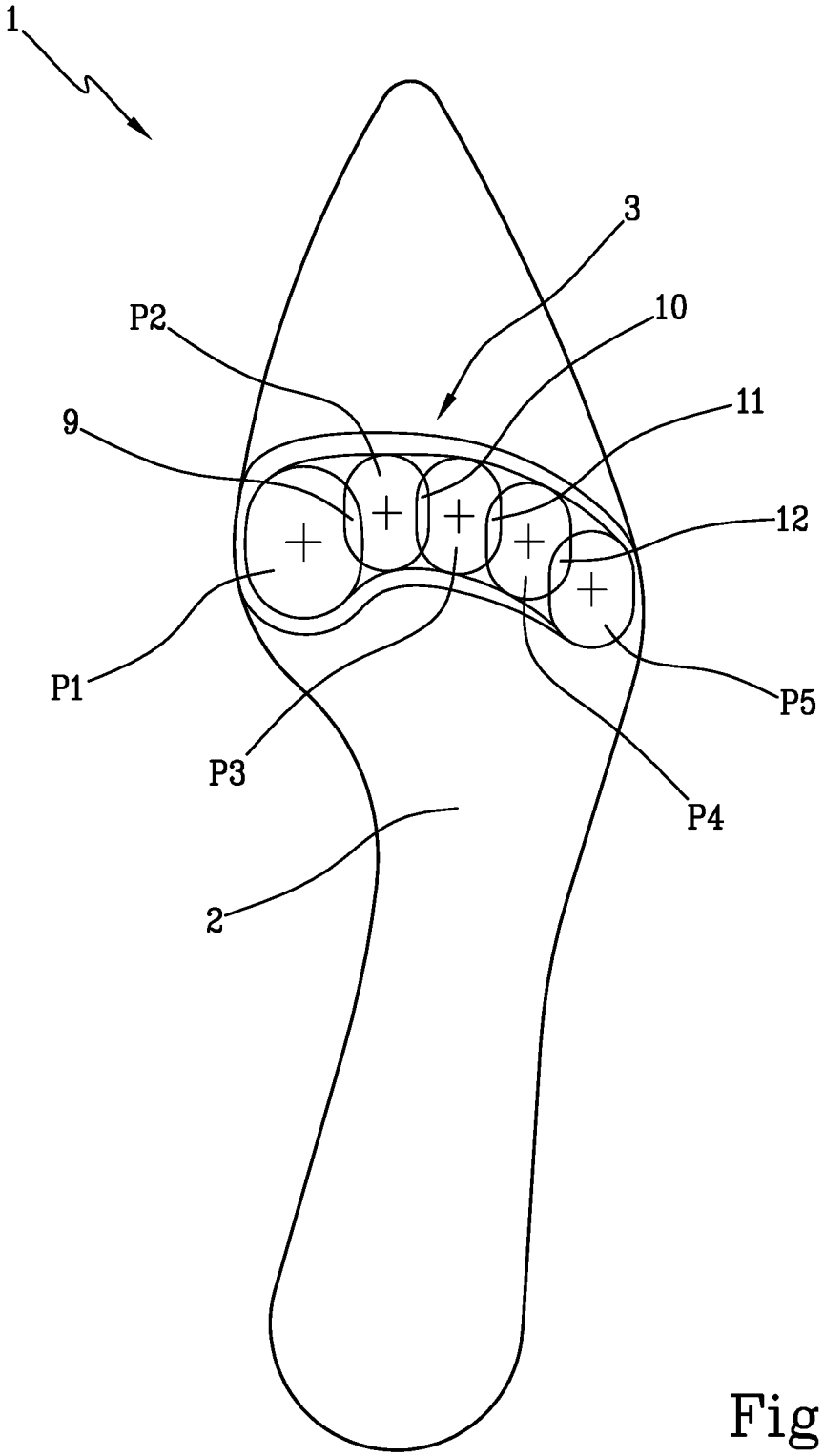
FIG. 1 is a view from above of a component for a shoe in accordance with the present invention.
Figure 2:
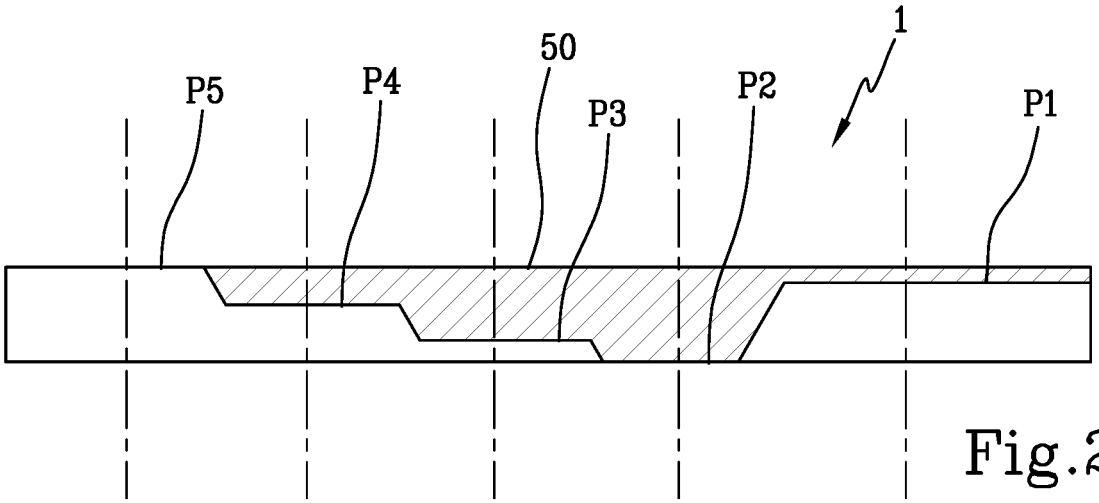
FIG. 2 is a sectional view of a portion of the component of FIG. 1.
Figure 3:
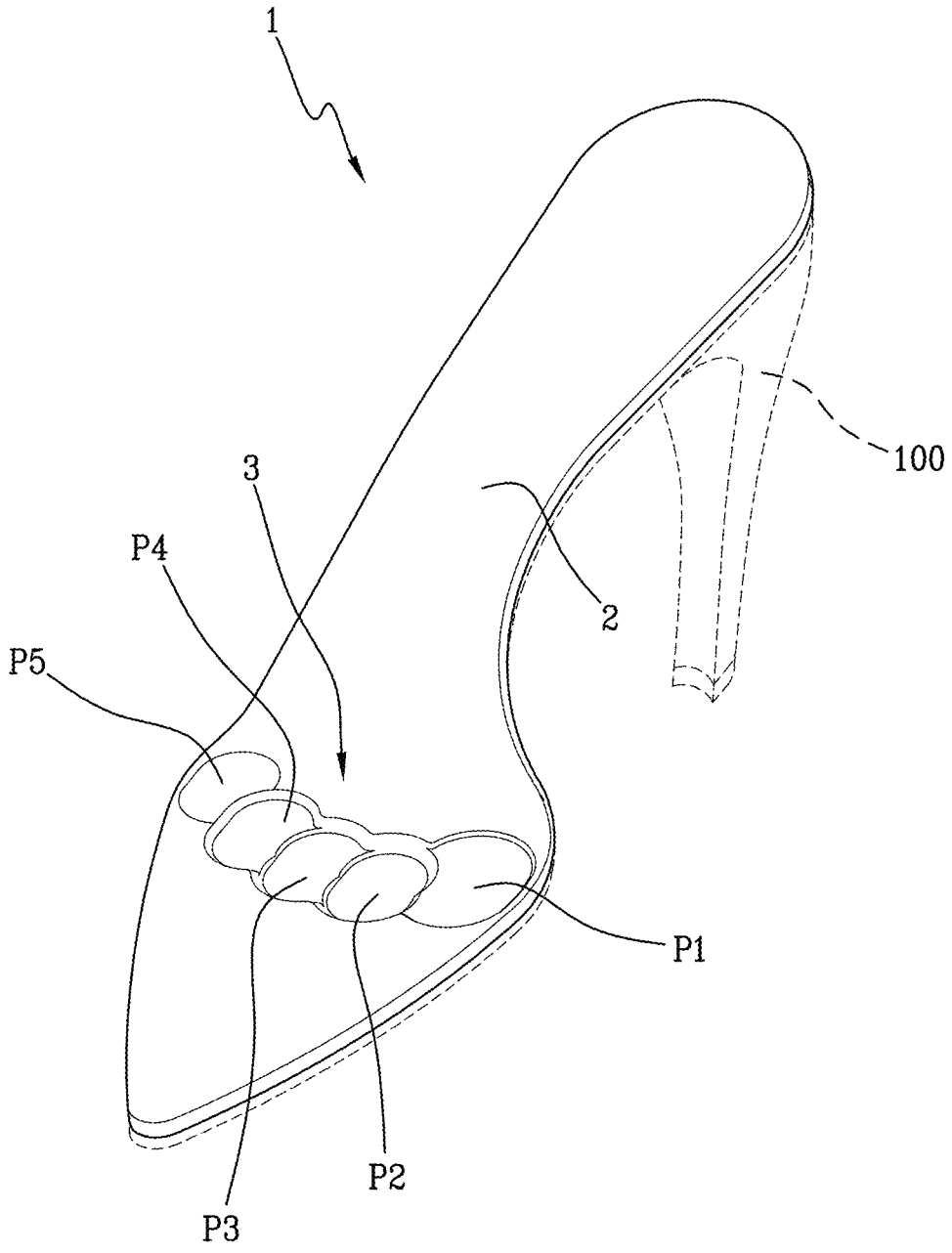
FIG. 3 shows a perspective view of the component of FIG. 1.

With reference to FIGS. 1 to 3, the numerical reference 1 generally indicates a component of a shoe, suitable for being interposed between the foot of a user and the ground. The component 1 can be an insole, in which case it is intended to be positioned inside the shoe to come into direct contact with the user's foot. Alternatively, the component 1 can be a sole intended to come into contact with the ground. It is also possible that the component 1 is shaped as a mounting footbed or midsole, intended to be positioned between the insole and the sole.

In particular, in the appended figures a component 1 suitable for being used in a high-heeled shoe has been shown by way of non-limiting example.

The component 1 is delimited by an upper surface 2 which is intended to be turned, in use, towards the foot of a user, more particularly towards the plantar surface of the foot.

The upper surface 2 comprises a load-bearing region 3 which is at least partially recessed with respect to a surrounding area of the upper surface 2.

The load-bearing region 3 is configured and positioned so as to accommodate the plantar region of the foot which comprises the portion between the metatarsal bones and the proximal phalanges.

In particular, said load-bearing region 3 is configured to at least partially accommodate the metatarsal heads of the foot.

A plurality of metatarsal support levels are defined on the load-bearing region 3. In the example shown, the metatarsal support levels are shaped like metatarsal support planes. In particular, said metatarsal support planes comprise a first plane P1, a second plane P2, a third plane P3, a fourth plane P4 and a fifth plane P5.

The second plane P2, the third plane P3 and the fourth plane P4 are placed between the first plane P1 and the fifth plane P5.

In other words, the number of metatarsal support planes P1, P2, P3, P4, P5 coincides with the number of metatarsals present in the human foot, wherein the first metatarsal support plane P1 refers to the metatarsal support plane configured to support the head of the first metatarsal and the fifth metatarsal support plane P5 refers to the metatarsal support plane configured to support the head of the fifth metatarsal. The second metatarsal plane P2, the third metatarsal plane P3 and the fourth metatarsal plane P4 are configured to support the head of the second, third and fourth metatarsals, respectively.

In order to improve the balancing of the user's weight on the metatarsal heads, the load-bearing region 3 has a shape that adapts to the physiological structure of the foot when the latter is in a load condition and in a plantarflexion configuration, i.e. the typical walking condition with high-heeled shoes or the typical walking condition in the propulsive phase.

The metatarsal support planes P1, P2, P3, P4, P5 identify metatarsal support levels placed at different heights from one another, when the component 1 is in a configuration of use in which the upper surface 3 is turned upwards.

In other words, the metatarsal support planes P1, P2, P3, P4, P5 are formed at different depths.

In this description, the term "depth" means the distance, measured along the normal to the metatarsal support planes, between the respective metatarsal support plane and the surrounding areas of the upper surface 2.

More in detail, the second metatarsal support plane P2 is arranged, in the configuration of use, at a maximum depth with respect to the surrounding areas of the upper surface 2. This means that the second metatarsal support plane P2 delimits a recess that penetrates more into the component 1 than the recesses delimited by the other metatarsal support planes.

In other words, the second metatarsal support plane P2, in the configuration of use, is arranged at the greatest depth between the depths at which the first metatarsal support plane P1, the third metatarsal support plane P3, the fourth support plane metatarsal P4 and the fifth metatarsal support plane P5 are placed.

Furthermore, the third metatarsal support plane P3 is arranged, in the configuration of use and depending on the particular embodiment, at a depth lower than or equal to the depth of the second metatarsal support plane P2, but greater than the depths of the first metatarsal support plane P1, of the fourth metatarsal support plane P4 and of the fifth metatarsal support plane P5.

The fifth metatarsal support plane P5 is, in a configuration of use, arranged at a higher level than the remaining metatarsal support planes P1, P2, P3, P4. In the example shown, the fifth metatarsal support plane P5 is not arranged recessed in the load-bearing region 3, that is, no recess is made on the load-bearing region 3 at the fifth metatarsal support plane P5.

The remaining metatarsal support planes, i.e. the first plane P1 and the fourth plane P4, are instead arranged at intermediate depths whose specific value is defined depending on the particular embodiment.

Below different embodiments of component 1 for shoes are discussed.

FIG. 2 is a sectional view of a first embodiment of the component 1 in accordance with the present invention.

In this embodiment, the second metatarsal support plane P2 is arranged, in the configuration of use, at a depth greater than the other metatarsal support planes P1, P3, P4, P5. This means that the second metatarsal support plane P2 is, in use, at the lowest height with respect to the remaining metatarsal support planes P1, P3, P4, P5.

The third metatarsal support plane P3 is arranged, in the configuration of use, at a depth lower than the second metatarsal support plane P2 but greater than the remaining metatarsal support planes P1, P4, P5.

The fourth metatarsal support plane P4 is arranged, in use, at a depth lower than the second plane P2 and the third plane P3, but greater than the first plane P1 and the fifth plane P5.

Furthermore, the first metatarsal support plane P1 is arranged, in the configuration of use, at a depth which is intermediate with respect to the depths of the fourth metatarsal support plane P4 and of the fifth metatarsal support plane P5.

In particular, the fifth metatarsal support plane P5 is not arranged recessed with respect to the load-bearing region 3, i.e. it is at the same level as the surrounding areas of the load-bearing region 3.

In summary, in a configuration of use, the second metatarsal support plane P2 is located at the lowest level. The third plane P3, the fourth plane P4, the first plane P1 and the fifth plane P5 are located, in this order, at progressively higher levels.

Preferably, the absolute value of the depths of the respective metatarsal support planes P1, P2, P3, P4, P5 is defined as a function of the size of the component 1, which is in turn correlated to the size of the user's foot.

Preferably, the relative value of the depths of the respective metatarsal support planes P1, P2, P3, P4, P5 is as follows:

- the depth of the first metatarsal support plane P1 is 2/7 the depth of the second metatarsal support plane P2;
- the depth of the third metatarsal support plane P3 is 6/7 the depth of the second metatarsal support plane P2;
- the depth of the fourth metatarsal support plane P4 is 3/7 the depth of the second metatarsal support plane P2.

The metatarsal support planes P1, P2, P3, P4 can be defined by respective bottom surfaces of corresponding slots placed side by side. These slots, which may have elongated shapes, mainly extend along respective parallel longitudinal extension axes.

The transversal and longitudinal positioning of each metatarsal support plane P1, P2, P3, P4, P5 takes into account the different types of foot and in particular the different conformations of the metatarsal arches, wherein with types of foot reference is made to the most common ones, such as: Greek, Roman, Egyptian and Germanic.

The central point of the different metatarsal support planes P1, P2, P3, P4, P5, which has been indicated with a cross in FIG. 1, can for example be based on an average obtained through a data collection on a group of sample subjects.

Advantageously, in this way, the component 1 can be adapted and optimized to function best depending on the type of foot of the user.

The recesses whose bottom surfaces define the metatarsal support planes P1, P2, P3, P4, P5 can be filled with a filler material 50 which can be soft, in particular a soft touch material. This allows increasing the comfort for the user.

A coating layer, not shown, which extends over the entire upper surface 2, can also be provided above the filler material 50.

In this way, the recesses whose bottom surfaces define the support planes P1, P2, P3, P4, P5 are not visible in the finished shoe, but the presence thereof is easily perceived by the user as the filler material 50 is much more yielding than the material forming the upper surface 2.

The metatarsal support planes P1, P2, P3, P4 have a substantially slot or elliptical profile and define, as already mentioned, the bottom surface of respective recesses, which can be laterally delimited for example by flared edge areas.

In particular, each metatarsal support plane P1, P2, P3, P4 can define a flat bottom wall of a recess having side walls inclined and converging downwards.

The planar profiles, i.e. in plan view, of the adjacent metatarsal support planes P1, P2, P3, P4, P5 are at least partially intersected.

This intersection between the planar profiles defines a connecting region 9, 10, 11, 12 for each pair of adjacent metatarsal support planes P1, P2, P3, P4, P5.

In other words, the load-bearing region 3 comprises four connecting areas 9, 10, 11, 12 comprised respectively between the planar profiles of the first plane P1 and second plane P2, of the second plane P2 and third plane P3, of the third plane P3 and fourth plane P4, of fourth plane P4 and fifth plane P5.

In particular, each of the connecting regions 9, 10, 11, 12 has a ramp profile configured to join the metatarsal support planes P1, P2, P3, P4, P5 which define the respective connecting region 9, 10, 11, 12.

In this way, these connecting regions 9, 10, 11, 12 are particularly adapted to conform the structure of the load-bearing region 3 to the anatomy of the user's foot.

Furthermore, as visible in FIG. 3, this ramp profile is made between the upper surface portion 2 surrounding the load-bearing region 3 and the load-bearing region 3.

In other words, each metatarsal support plane P1, P2, P3, P4, which is hollowed out with respect to the surrounding areas of the upper surface 2, is at least partially surrounded by a ramp profile which joins the base of the metatarsal support planes to the portion of the adjacent upper surface 2.

Figure 4:
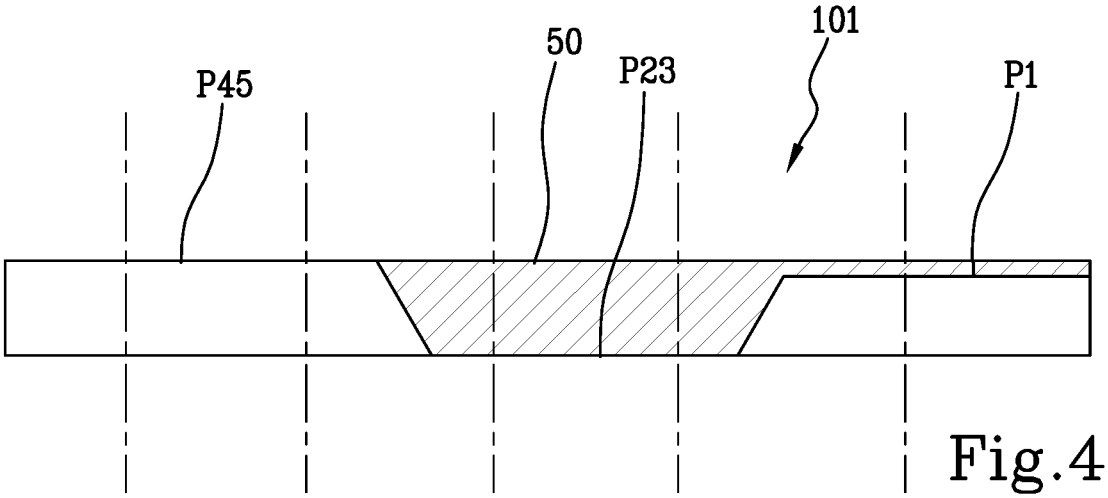
FIG. 4 is a sectional view like that of FIG. 2, relating to a component for a shoe according to an alternative embodiment.

FIG. 4 shows a component 101 according to an alternative embodiment. While the component 1 described with reference to FIGS. 1 to 3 had five metatarsal support levels P1, P2, P3, P4 and P5, placed at different heights from one another, to support the five metatarsal heads of the foot, in the example of FIG. 4 there are only three metatarsal support levels P1, P23, P45.

In particular, in the component 101 it is possible to define a lowest metatarsal support level P23 for supporting the second and the third metatarsal heads, an intermediate metatarsal support level P1 for supporting the first metatarsal head, and a highest metatarsal support level P45 for supporting the fourth and the fifth metatarsal heads.

The intermediate metatarsal support level P1, the lowest metatarsal support level P23 and the highest metatarsal support level P45 can be defined by respective substantially flat surfaces.

The lowest metatarsal support level P23 can be defined as the bottom surface of a recess, made in the load-bearing region 3, so dimensioned as to at least partially accommodate the second and the third metatarsal heads.

The intermediate metatarsal support level P1 can be defined as the bottom surface of a further recess, made in the load-bearing region 3, so dimensioned as to at least partially accommodate the first metatarsal head.

The highest metatarsal support level P45 can be defined by a surface arranged flush with the surrounding areas of the upper surface 2, i.e. not recessed.

The lowest metatarsal support level P23 is arranged at a lower height than the intermediate metatarsal support level P1 and the highest metatarsal support level P45.

The intermediate metatarsal support level P1 is arranged at an intermediate height between the height of lowest metatarsal support level P23 and the height of the highest metatarsal support level P45.

The highest metatarsal support level P45 is arranged at a higher height than the intermediate metatarsal support level P1 and the lowest metatarsal support level P23.

Preferably, the intermediate metatarsal support level P1 is arranged at a depth equal to 2/7 the depth of the lowest metatarsal support level P23. The highest metatarsal support level P45 is instead arranged at a zero depth with respect to the surrounding areas of the upper surface 2, i.e. it is not recessed.

Figure 5:
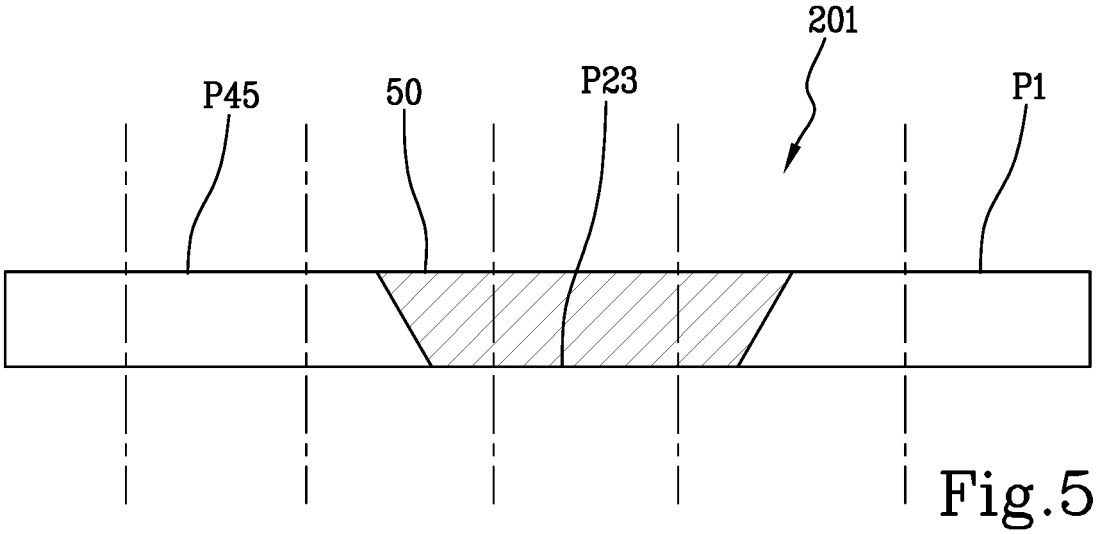
FIG. 5 is a sectional view like that of FIG. 2, relating to a component for a shoe according to another alternative embodiment.

FIG. 5 shows a component 201 according to a further alternative embodiment. In the component 201, only two distinct levels of metatarsal support are provided.

In particular, in the component 201 it is possible to define a highest metatarsal support level for supporting the first, the fourth and the fifth metatarsal heads, and a lowest metatarsal support level P23 for supporting the second and the third metatarsal heads.

The highest metatarsal support level may comprise a surface portion P1 for supporting the first metatarsal head and a further surface portion P45 for supporting the fourth and the fifth metatarsal heads.

The surface portion P1 and the further surface portion P45 are arranged at the same level.

The surface portion P1 and the further surface portion P45 can be substantially flat.

The lowest metatarsal support level P23 can be defined by a substantially flat surface.

The lowest metatarsal support level P23 can be defined as the bottom surface of a recess, made in the load-bearing region 3, so dimensioned as to at least partially accommodate the second and the third metatarsal heads.

The surface portion P1 and the further surface portion P45 can be arranged flush with the surrounding areas of the upper surface 2, i.e. not recessed.

The lowest metatarsal support level P23 is arranged at a lower height than the highest metatarsal support level.

Advantageously, the present invention achieves the intended objects by limiting the drawbacks complained of in the prior art and making available a component of a shoe capable of obtaining a more efficient distribution of the weight force on all the five metatarsal heads.

In fact, since the metatarsal support planes are made at different depths, and in particular at depths that allow a more functional positioning of the metatarsal heads when the foot is in a plantarflexion configuration, each metatarsal head can rest on a respective metatarsal support plane positioned consistently with the physiology of the foot.

In other words, the component of a shoe according to the present invention provides a better and more functional metatarsal support plane for each metatarsal head, designed on the basis of the dimensions and the height differential of the shoe.

A further object achieved is to make available a component of a shoe capable of improving the comfort of the user.

In fact, thanks to the presence of the load-bearing region, at least partially hollowed out and counter-shaped with respect to the metatarsal heads of the foot, the aforementioned component limits the anterior sliding of the foot with respect to the shoe, thus preventing the onset of aesthetic problems such as jammed fingers and the emptying of the rear part of the shoe.

A further object achieved is to make available a component of a shoe capable of improving the balance and the stability of the user during all walking phases and in standing position, increasing the muscle involvement and specifically that of the buttocks.

In fact, thanks to the more uniform distribution of the loads on the metatarsal heads, the support of the foot is more stable for the benefit of the muscular structure of the human body and a smoother walk.

The present invention also relates to a shoe comprising the component 1 described above.

Preferably, the shoe has a high heel, i.e. equal to or higher than 60 mm, even if this condition is not necessary. The heel is shown in FIG. 3 with dashed lines and is indicated by the reference numeral 100.

The metatarsal support planes can be obtained by removing material or by thermoforming.

Advantageously, the shoe according to the present invention allows the user to maintain a better posture during use, reducing the onset of the problems described above.

In particular, the usability of shoes with a high height differential, i.e. high-heeled, is favoured.

The invention claimed is:

1. A component for a shoe, intended to be interposed between a foot and the ground, said component being delimited by an upper surface which, in use, is turned towards the foot, the upper surface comprising a load-bearing region in which at least one recess is made, the at least one recess being configured to receive at least one metatarsal head of the a plurality of metatarsal heads of the foot, so that in the load-bearing region a plurality of metatarsal support levels is defined, the plurality of metatarsal support levels being placed at different heights from one another and being intended to support the plurality of metatarsal heads of the foot, wherein said plurality of metatarsal support levels comprises five metatarsal support levels including:

a lowest metatarsal support level;

a further metatarsal support level, a third metatarsal support level, a fourth metatarsal support level, a highest metatarsal support level, wherein:

the further metatarsal support level is a first metatarsal support plane configured to support a first metatarsal head of the plurality of metatarsal heads of the foot;

the lowest metatarsal support level is a second metatarsal support plane configured to support a second metatarsal head of the plurality of metatarsal heads of the foot, the second metatarsal support plane being adjacent to the first metatarsal support plane and distinct from the first metatarsal support plane;

the third metatarsal support level is a third metatarsal support plane configured to support a third metatarsal head of the plurality of metatarsal heads of the foot, the third metatarsal support plane being adjacent to the second metatarsal support plane and distinct from the second metatarsal support plane;

the fourth metatarsal support level is a fourth metatarsal support plane configured to support a fourth metatarsal head of the plurality of metatarsal heads of the foot, the fourth metatarsal support plane being adjacent to the third metatarsal support plane and distinct from the third metatarsal support plane;

the highest metatarsal support level is a fifth metatarsal support plane configured to support a fifth metatarsal head of the plurality of metatarsal heads of the foot, the fifth metatarsal support plane being adjacent to the fourth metatarsal support plane and distinct from the fourth metatarsal support plane.

2. The component according to claim 1, wherein the third metatarsal support level is higher than the lowest metatarsal support level and lower than the further metatarsal support level.

3. The component according to claim 1, wherein the fourth metatarsal support level is higher than the third metatarsal support level.

4. The component according to claim 1, wherein the fourth metatarsal support level is lower than the further metatarsal support level.

5. The component according to claim 1, wherein said highest metatarsal support level is arranged flush with zones of the upper surface outside of the at least one recess.

6. The component according to claim 1, comprising a filler material that fills said at least one recess, the filler material being more yielding than a material forming a region of the upper surface of the component surrounding the filler material.

7. The shoe comprising the component according to claim 1.

8. The shoe according to claim 7, wherein said component is selected from a group comprising: a sole of the shoe, an insole of the shoe, a midsole of the shoe.

9. The shoe according to claim 7, having a heel higher than or equal to 60 mm.

10. The component according to claim 1, wherein the at least one recess is surrounded by a surrounding area of the upper surface and, when the component is in a use configuration with the upper surface facing upwards, the second metatarsal support plane is at a depth from the surrounding area, the first metatarsal support plane being at a depth form the surrounding area equal to 2/7 the depth of the second metatarsal support plane, the third metatarsal support plane being at a depth form the surrounding area equal to 6/7 the depth of the second metatarsal support plane, the fourth metatarsal support plane being at a depth form the surrounding area equal to 3/7 the depth of the second metatarsal support plane.

11. The component according to claim 1, wherein, when the component is in a use configuration with the upper surface facing upwards, the first metatarsal support plane, the second metatarsal support plane, the third metatarsal support plane, the fourth metatarsal support plane, the fifth metatarsal support plane are each distinct substantially flat planes.

* * * * *